US007955135B2

(12) United States Patent
Wang et al.

(10) Patent No.: US 7,955,135 B2
(45) Date of Patent: Jun. 7, 2011

(54) ELECTRICAL CARD CONNECTOR WITH AT LEAST A RETENTION PIECE EXTENDING VERTICALLY FROM CONTACT

(75) Inventors: Leland Wang, Kunshan (CN); Yun-Jen Lee, Tu-Cheng (TW); Jing-Jie Guo, Shenzhen (CN); Wei-Ping Liu, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 182 days.

(21) Appl. No.: 12/477,929

(22) Filed: Jun. 4, 2009

(65) Prior Publication Data

US 2009/0305522 A1 Dec. 10, 2009

(30) Foreign Application Priority Data

Jun. 4, 2008 (CN) ..... 200820037226

(51) Int. Cl.
*H01R 24/00* (2006.01)

(52) U.S. Cl. ..... 439/630; 439/862

(58) Field of Classification Search ..... 439/862, 439/630

See application file for complete search history.

(56) References Cited

U.S. PATENT DOCUMENTS

| | | | | |
|---|---|---|---|---|
| 6,994,566 | B2 * | 2/2006 | You | 439/66 |
| 7,086,904 | B1 * | 8/2006 | Kuan et al. | 439/630 |
| 7,510,444 | B2 * | 3/2009 | Chang et al. | 439/630 |
| 7,611,385 | B1 * | 11/2009 | Gao et al. | 439/630 |
| 7,670,185 | B2 * | 3/2010 | Zhang et al. | 439/630 |

* cited by examiner

*Primary Examiner* — Xuong M Chung Trans
(74) *Attorney, Agent, or Firm* — Ming Chieh Chang; Wei Te Chung; Andrew C. Cheng

(57) ABSTRACT

A card connector, comprising an insulative housing having a base, a plurality of passageways extending along a widthwise direction of the base, a plurality of retention slots defined on two lengthwise sides of each passageway, and a plurality of contacts received in the respective passageways. Each contact has a planar soldering section on a side of the planar section; a beam section extending from the side of the planar section opposite to the soldering section; the beam section defining an arc contact section on a free end; the planar section having a number of retention pieces received in the retention slots. The retention pieces are defined perpendicular to an extending direction of the soldering section.

5 Claims, 4 Drawing Sheets

ELECTRICAL CARD CONNECTOR WITH AT LEAST A RETENTION PIECE EXTENDING VERTICALLY FROM CONTACT

BACKGROUND OF THE INVENTION

1. Field of the Invention

The present invention relates to an electrical card connector, and more particularly, to an electrical card connector provided with contact retention mechanisms for making the contacts stable in the housing of an electrical card connector to prevent the contacts from dropping out.

2. Description of Related Art

Electrical cards are known in the art and contain intelligence in the form of a memory circuit or other electronic program. Some form of card readers retrieve the information or data stored on the card. Such cards are used in many applications in today's electronic society, including video cameras, digital still cameras, smart phones, PDAs, music players, ATMs, cable television decoders, toys, games, PC adapters, multi-media cards and other electronic applications, etc.

Example of prior art contact of a card-receiving connector as patent CN 200620067877 of Chinese mainland comprises a planar engaging section; a contact section at the front of a terminal presenting an arc; a connecting section which keeps a resilient connection between the engaging section and the contact section; a soldering section extending from an end of the engaging section.

With the development of the card-receiving connector, thin connector and light connector have been a tendency. Therefore, insulative housing should become thinner and lighter to go with the tide. Meanwhile, it will be more difficult to define horizontally a plurality of passageways on the insulative housing if the card-receiving connector get thinner and lighter, and also, the pressure laid on the contacts by an electrical card can damage the edges of the passageways. It will make the contacts unstable in the insulative housing.

Therefore, an improved electrical card connector is desired to overcome the disadvantages of the prior arts.

SUMMARY OF THE INVENTION

An object, therefore, of the invention is to provide a new and improved electrical card connector having at least a retention piece extending vertically from each contact and making the contacts stable in the electrical card connector through the engaging cooperation between the retention piece and the insulative housing.

In order to achieve the above-mentioned object, an electrical card connector comprises: an insulative housing having a base; a plurality of passageways defined on the base symmetrically receiving a plurality of contacts; and the passageways extending along the widthwise direction of the base; a plurality of retention slots defined on the two lengthwise sides of each passageway; and the retention slot running through the base from top to bottom; a plurality of contacts received in the passageways of the base; each contact having a planar section with a soldering section defined on a side of the planar section; a beam section extending from the side of the planar section opposite to the soldering section; the beam section defining an arc contact section on a free end; the planar section having a number of retention pieces received in the retention slots correspondingly, the retention pieces defined perpendicular to an extending direction of the soldering section; a shield shell having a top section, the top section defining a pair of side faces on two opposite sides.

Other objects, advantages and novel features of the present invention will become more apparent from the following detailed description of the present embodiment when taken in conjunction with the accompanying drawings.

DETAILED DESCRIPTION OF THE INVENTION

Reference will now be made in detail to the preferred embodiment of the present invention.

Figure 1:
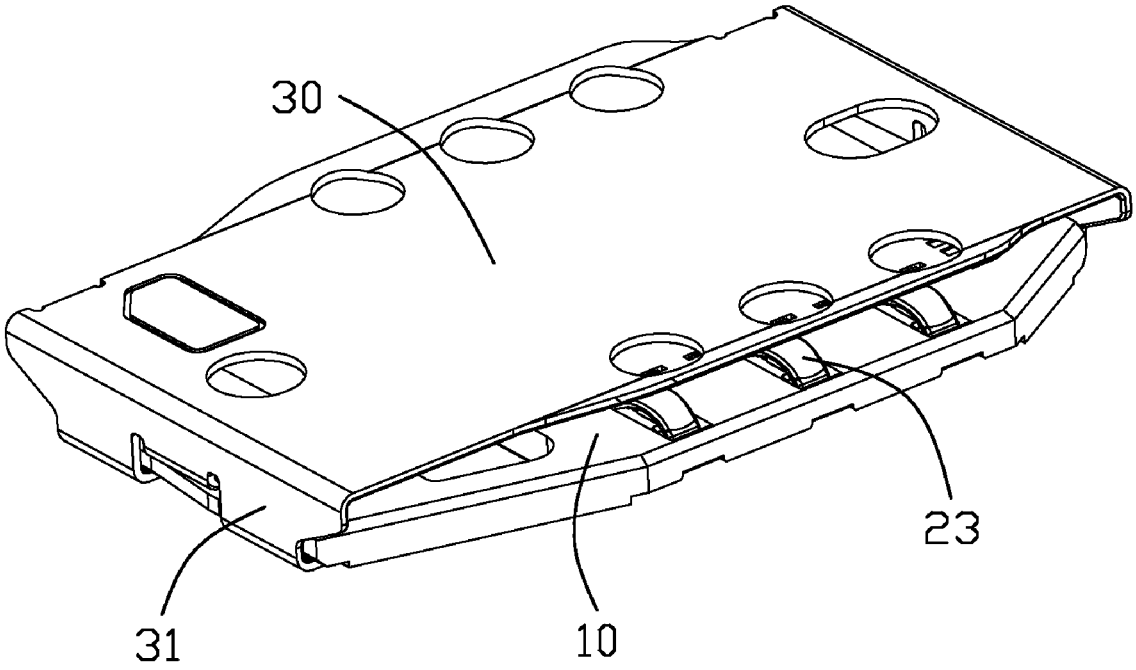
FIG. 1 is an assembled, perspective view of the present invention.
Figure 2:
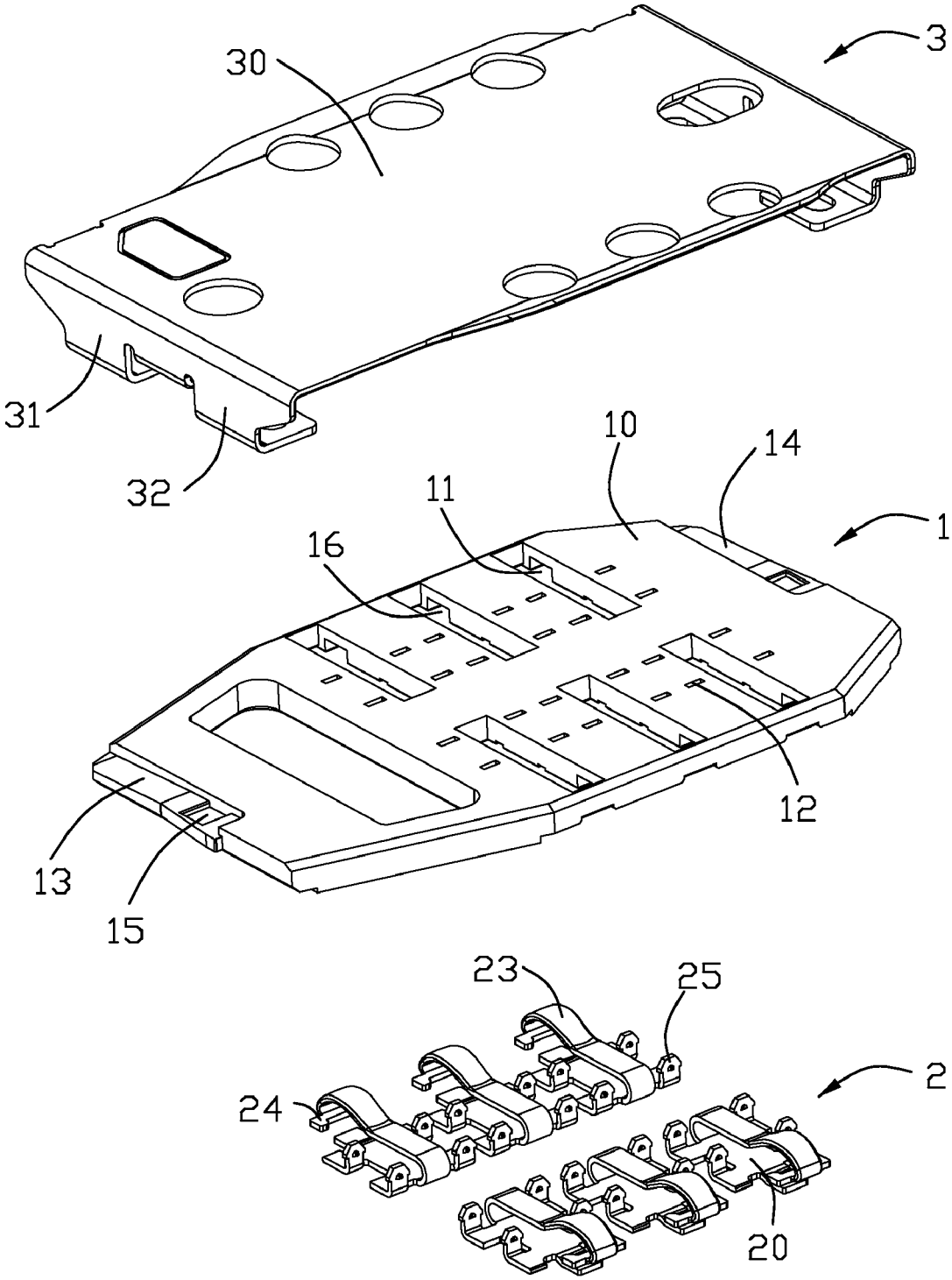
FIG. 2 is an exploded, perspective view of the electrical card connector as shown in FIG. 1.
Figure 3:
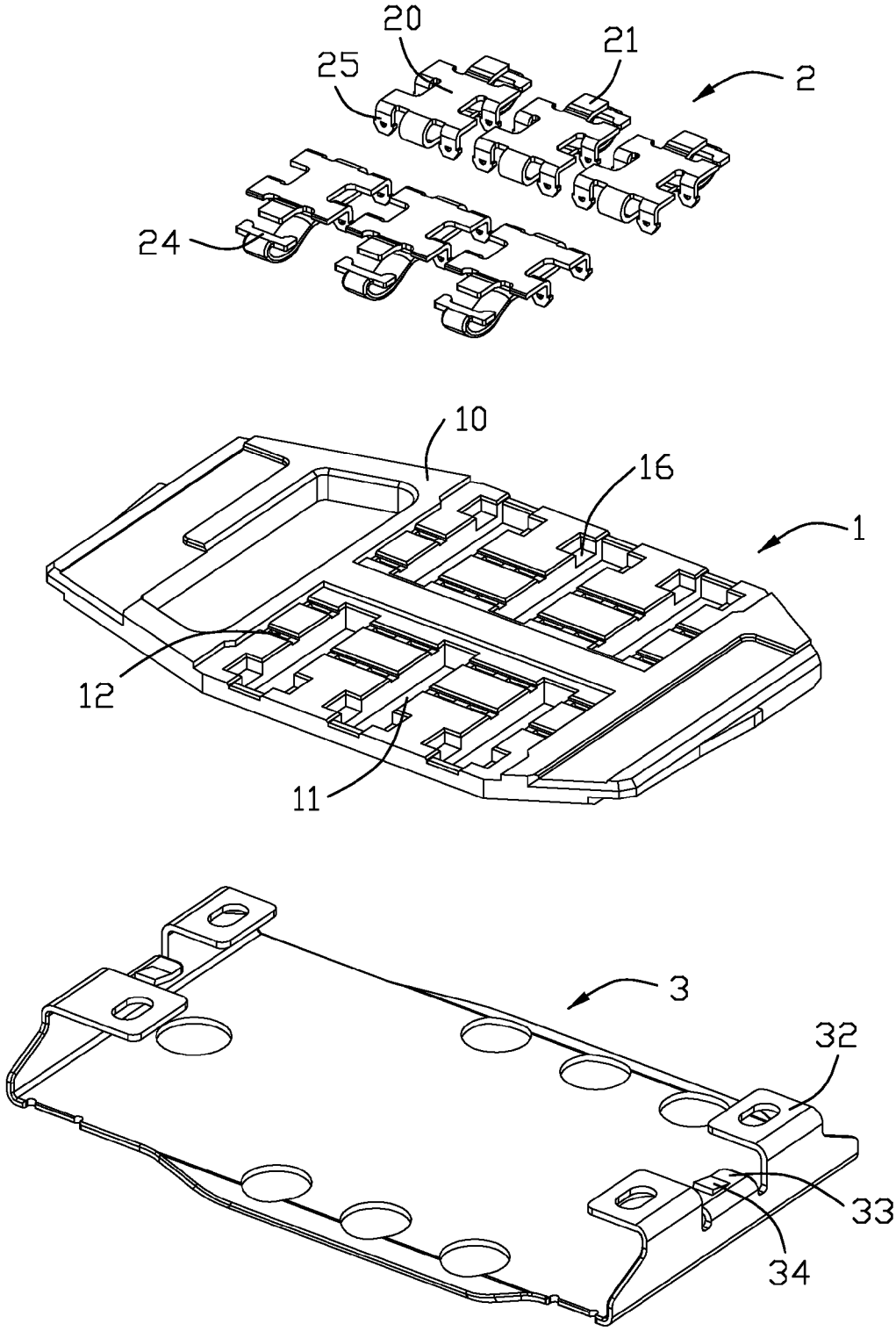
FIG. 3 is an exploded, perspective view of the electrical card connector as shown in FIG. 2 from another view.
Figure 4:
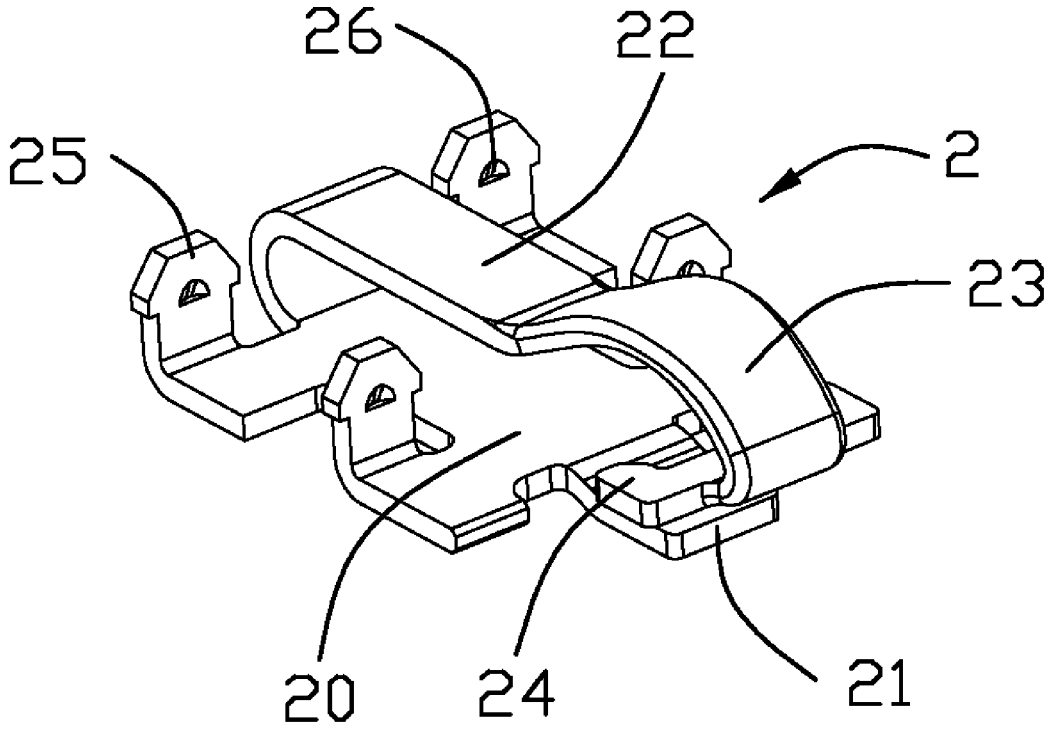
FIG. 4 is a perspective view of a terminal as shown in FIG. 1.

Referring to FIGS. 1-4, an embodiment of the present invention illustrated. An electrical card connector for electrically connecting an electrical card and a printed circuit board comprises an insulative housing 1 with a plurality of contacts 2 assembled therein; and a shield shell 3 covering the insulative housing 1.

The insulative housing 1 includes a base 10 with a plurality of passageways 11 defined symmetrically thereon. The passageways 11 extend along the longitude direction of the insulative housing 1 and receive the contacts 2. A pair of retention slots 12 is defined on each side of corresponding passageway 11. The retention slots 12 are defined symmetrically to each passageway 11. The retention slots 12 runs through the base 10 from top to bottom. A pair of slide ways 13 is defined on two opposite ends of the insulative housing 1 on the transverse direction, the slide ways 13 are linked with just one side of the insulative housing 1. An inclined surface 14 is defined in each slide way 13; a receiving slot 15 is defined on an end of the slide way 13. The notch sections 16 are defined on the bottom surface of the insulative housing 1.

The contact 2 has a rectangular planar section 20. A soldering section 21 and a beam section 22 are defined on two opposite sides of the planar section 20 respectively. A contact section 23 which presents an arc is defined on the free end of the beam section 22. The free end of the contact section 23 bends and extends parallel to the planar section 20 and forms a tab 24. A pair of retention pieces 25 extends vertically from one of the other two sides of the planar section 20; and the retention pieces 25 are defined symmetrically on the sides of the planar section 20. Particularly, the retention pieces 25 are perpendicular to an extending direction of the soldering section 21. A dimple section 26 is defined on the surface of each retention piece 25 to make a better retention between the retention pieces 25 and the retention slots 12.

The shield shell 3 has a top section 30. Two side faces 31 are defined symmetrically on two opposite sides of the top section 30. A pair of retaining section 32 is defined on each side face 31; a slide section 33 is defined between the retaining sections 32 on each side face 31 according to the slide ways 13 of the insulative housing 1. Each slide section 33 has a resilient section 34 extended therefrom.

When assembly, the contacts 2 are inserted into the passageways 11 upwardly from the bottom of the insulative housing 1; the retention pieces 25 retain in the retention slots 12 correspondingly. The tabs 24 retain in the notch sections 16 correspondingly to prevent the contact sections 22 from dropping out of the passageways 11. The shield shell 3 is assembled onto the insulative housing 1 from the side which links with the slide ways 13 of the insulative housing 1. The resilient sections 34 retain in the receiving slots 15 correspondingly.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A card connector, comprising:

an insulative housing having a base, a plurality of passageways symmetrically defined on the base receiving a plurality of contacts; the passageways extending along a widthwise direction of the base; a plurality of retention slots defined on two lengthwise sides of each passageway and through the base from top to bottom;

a plurality of contacts received in the passageways of the base, each contact having a planar section with a soldering section defined thereon; a beam section bending and extending from a side of the planar section which is opposite to the soldering section; the beam section having an arc contact section defining above the passageway on a free end thereof; the planar section having a number of retention pieces received in the retention slots correspondingly, the retention pieces defined perpendicular to an extending direction of the soldering section; and a shield shell having a top section, the top section defining a pair of side faces on two opposite sides; wherein a tab is defined on the free end of each contact section, the tab bends and extends parallel to the planar section of each contact; wherein a pair of slide ways with a wedge surface is defined on two sides of the insulative housing; wherein the slide ways are linked with a side surface of the insulative housing; wherein a receiving slot is defined on the end of the slide way; wherein a pair of slide sections with a resilient section on each slide section is defined on two opposite sides of the shield shell corresponding to the slide ways.

2. The card connector as described in claim 1, wherein the retention piece presents a wedge shape with a dimple section defined thereon.

3. A card connector, comprising:

an insulative housing having an elongated base defining a lengthwise direction and a widthwise direction perpendicular to each other, a plurality of passageways located by opposite first and second sides of the base; each of the passageways extending through the base and along said widthwise direction; a plurality of retention slots located at two sides of each passageways with each extending through the base and along said lengthwise direction;

a plurality of contacts assembled into the respective passageways from a down-to-up direction, each contact stamped from a sheet of metal material and having a planar soldering section, a contact section extending from a first side of the planar section to locate above a top face of the base, and a plurality of vertical retention pieces on opposite second and third sides of the planar soldering section and securely held in the respective retention slots of each passageway, each of the vertical retention piece arranged parallel to said lengthwise direction defined by two adjacent contacts of any one of said first and second side of the base; and a metallic shell assembled upon the housing and including a top plate cooperating with the top face of the base to defining a card receiving cavity therebetween; wherein a tab is defined on a free end of each contact section, the tab bends and extends parallel to the planar section of each contact; wherein a pair of slide ways with a wedge surface is defined on two sides of the insulative housing; wherein the slide ways are linked with a side surface of the insulative housing; wherein a receiving slot is defined on the end of the slide way; wherein a pair of slide sections with a resilient section on each slide section is defined on two opposite sides of the metallic shell corresponding to the slide ways.

4. An electrical connector comprising:

an insulative housing defining opposite upper and bottom surfaces with a plurality of passageways extending therethrough in a vertical direction; a plurality of contacts disposed in the corresponding passageways, respectively, each of said contacts defining a main planar section, a plurality of retention pieces upwardly extending from two opposite lateral sides of the planar section, a soldering section extending from one longitudinal side of the planar section and downwardly offset from the planar section in a parallel relation, and a beam section extending from the other longitudinal side of the planar section opposite to the soldering section, and a contact section extending from an end of said beam section, a tab formed at a free end of the contact section, the tab bends and extends parallel to the planar section of each contact and engageably received in a cavity in the housing beside the corresponding passageway so as to form a preloading manner; and a metal shell attached to the housing with a main plane spaced above the upper surface; wherein the cavity does not communicate with the upper surface, and the contacts are assembled into the corresponding passageways upwardly from the bottom surface; wherein a pair of slide ways with a wedge surface is defined on two sides of the insulative housing; wherein the slide ways are linked with a side surface of the insulative housing; wherein a receiving slot is defined on the end of the slide way; wherein a pair of slide sections with a resilient section on each slide section is defined on two opposite sides of the metal shell corresponding to the slide ways.

5. The electrical connector as claimed in claim 4, wherein said retention piece extends in a plane perpendicular to the lateral side.

* * * * *